United States Patent [19]

Duggins et al.

[11] 4,176,452

[45] Dec. 4, 1979

[54] PICTURE FRAME MAT OPENING CUTTER

[75] Inventors: Richard W. Duggins, Hillsborough; James W. Rodgers, Durham, both of N.C.

[73] Assignee: Frameworks, Inc., Cedar Grove, N.C.

[21] Appl. No.: 909,673

[22] Filed: May 25, 1978

Related U.S. Application Data

[63] Continuation-in-part of Ser. No. 861,258, Dec. 16, 1979, abandoned.

[51] Int. Cl.[2] ..... B26B 29/00

[52] U.S. Cl. ..... 30/293; 30/294

[58] Field of Search ..... 30/293, 294, 289

[56] References Cited

U.S. PATENT DOCUMENTS 3,079,688 3/1963 Ryan ..... 30/294

FOREIGN PATENT DOCUMENTS 210936 11/1956 Australia ..... 30/293

*Primary Examiner*—Robert L. Spruill
*Assistant Examiner*—J. T. Zatarga
*Attorney, Agent, or Firm*—B. B. Olive

[57] ABSTRACT

A versatile mat opening cutter is adapted for cutting circular and oval openings, rectangular openings and, with the aid of a template, special shaped openings. The cutter body mounts a retractable cable wound on a spring-loaded, rotatable spool, an adjustable cutting blade, and a template follower. Circles and ovals are cut utilizing the retractable cable and positioning pins on a working surface. Special shaped openings are cut by using a template and the template follower.

14 Claims, 19 Drawing Figures

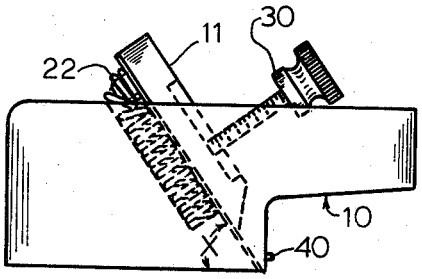
FIG. 1
FIG. 2
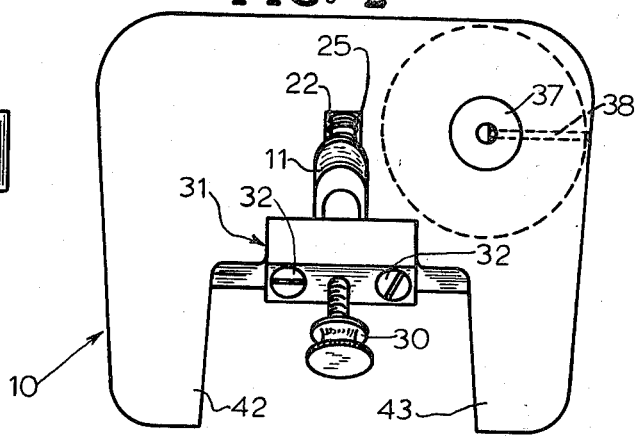
FIG. 3
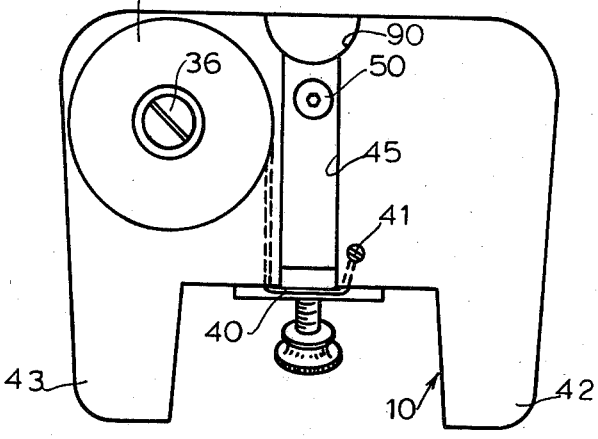
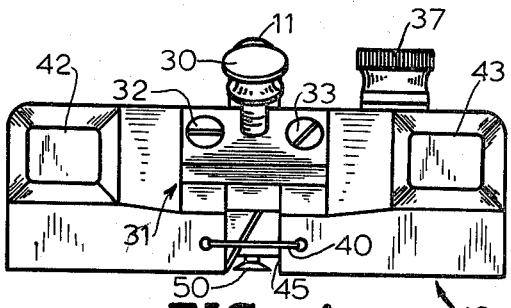
FIG. 4
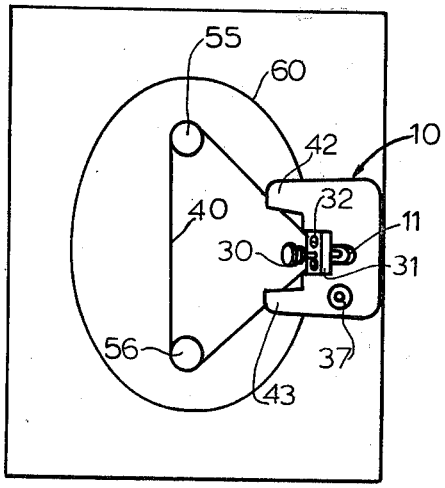
FIG. 5
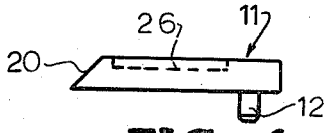
FIG. 6
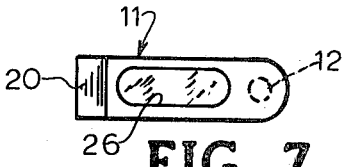
FIG. 7

PICTURE FRAME MAT OPENING CUTTER

CROSS-REFERENCE TO RELATED COPENDING APPLICATION

This application is a continuation-in-part of copending application Ser. No. 861,258, filed Dec. 16, 1977, which was abandoned coterminous with filing of this application.

BACKGROUND OF THE INVENTION

1. Field of the Invention

The cutter of the invention relates to devices intended for cutting picture frame mat openings.

2. Description of the Prior Art

It has been previously known to provide a picture frame mat opening cutter having a retractable spool wound cable and adjustable cutting blade arrangement for use with mat positioning pins to cut oval and circular openings for picture frame mats. Such a device has been sold as the Frameworks oval mat cutter by Frameworks, Inc., 130 North Bellvue Street, Hillsborough, North Carolina 27278. Such a device has been sold on a widespread basis and the construction and operation of the same has become known among those engaged in the picture framing business.

While the Frameworks oval mat cutter has provided a relatively simple, easy to use device for cutting ovals, circles and rectangles in picture frame mats, it has not been adapted to cutting of special shapes and has not been adapted for use with a template. Thus, the object of the present invention is to provide an improved picture frame mat opening cutter following the construction previously used in the Frameworks oval mat cutter but, in addition, providing means for cutting special shapes. More specifically, the present invention is aimed at providing an attachment which can be used with the Frameworks oval mat cutter and which will enable such cutter to be used to cut special shapes by means of following a template.

SUMMARY OF THE INVENTION

According to the present invention, there is provided a precision mat opening cutter which, like the previously mentioned Frameworks oval mat cutter, incorporates a retractable cable and adjustable cutting blade arrangement which can be used in conjunction with mat positioning pins on the working surface to cut oval and circular openings in picture frame mats. Of special interest to the present invention is the incorporation of, in the preferred embodiment, an attachment to the Frameworks oval mat cutter comprising an adjustable template guide which mounts in a slot provided on the bottom surface of the Frameworks oval mat cutter and which adapts such cutter to being used with a template to cut special mat opening shapes. The template guide can be placed in a position to be used with a template or can be placed in a reversed stored position when special shapes are not being cut requiring the use of a template. An alternative embodiment provides a template guide which is fixed in the cutter bottom surface but can be deployed or retracted without any necessary adjustment by the operator.

DESCRIPTION OF THE DRAWINGS

FIG. 1 is a side view of a cutter according to the invention adapted for oval or circular openings.

FIG. 2 is a top plan view of the cutter of FIG. 1.

FIG. 3 is a bottom plan view of the cutter without the template guide of the invention as in FIG. 1.

FIG. 4 is a front end view of the cutter without the template guide of the invention as in FIGS. 1, 2 and 3.

FIG. 5, at a reduced scale, illustrates use of the cutter for cutting an oval shape according to prior art practices.

FIG. 6 is an elevation view of the blade support bar.

FIG. 7 is a plan view of the top of the blade support bar.

DESCRIPTION OF THE PREFERRED EMBODIMENT

Figure 8:
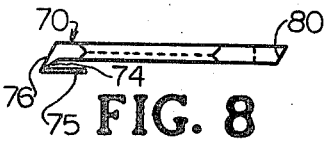
FIG. 8 is an elevation view of the template guide bar.
Figure 9:
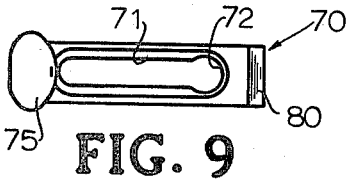
FIG. 9 is a plan view of the bottom of the template guide bar.

Referring to the drawings, the description will first be directed to describing the construction of the previously known Frameworks mat opening cutter. Later description will be directed to the template guide bar construction and their use which is the principle subject of the present invention.

Referring initially to FIGS. 1–7 and 14, the cutter body 10 slidably mounts in a central, angularly disposed guide slot 25 a blade support bar 11. Blade support bar 11 has an integral pin 12 extending from its back surface which serves dual purposes. One purpose of pin 12 is to receive an aperture 14 of a cutter blade 15 which mounts against the back surface of blade support bar 11 and with the cutting edge 16 of blade 15 extending outwardly below the top tapered surface 20 of blade support bar 11. Blade 15 is of a type of mat cutter blade manufactured and sold by Russell Harrington Cutlery Co. of Southbridge, Massachusetts, as a No. 3 Dexter Mat Cutter Blade.

Pin 12 also serves to receive one end of a coiled spring 22, see FIGS. 1 and 2, which is otherwise mounted immediately behind blade support bar 11 in an appropriate portion of angularly disposed guide slot 25 provided in body 10. It will also be noted that blade support bar 11 includes a hollowed out cavity 26. A locking screw 30 is threadably mounted in a mounting member 31 centrally secured to body 10, see FIGS. 2, 4, 5 and 7, by screws 32 and which allows the inner end of locking screw 30 to be moved into and out of contact with the bottom surface of cavity 26 so as to allow blade support bar 11 and mounted blade 15 to be adjustably positioned for cutting. Of course, it will be understood that anytime locking screw 30 is loosened that coil spring 22 will force blade support bar 11 and mounted blade 15 upwardly into a safe retracted position within cutter body 10. Locking screw 30 can then be tightened so that bar 11 and blade 15 are in a safe locked position for storage.

Body 10 also mounts a spring-loaded spool 35 on a mounting screw 36 having a flat surface loosely engaged by a locating pin 38 as indicated and which prevents screw 36 from rotating on its own axis. Screw 36 can be tightened by a locking knob 37 so as to prevent rotation of spool 35. Alternatively, locking knob 37 can be loosened which allows spool 35 to rotate and to release the cable 40 which is wound around spool 35 and has one end secured by an appropriate lock arrangement 41. A pair of arm portions 42, 43 are provided to assist in grasping the cutter during use.

To complete the description of this portion of the cutter construction, it may be noted that body 10 includes a horizontal guide slot 45 which extends across cutter body 10 on the bottom surface of body 10 as shown best in FIGS. 3 and 4. Horizontal guide slot 45 includes a locking screw 50 whose purpose is later explained. In using the cutter construction previously explained, blade support bar 11 is extended downwardly so as to expose cutting edge 16 of blade 15 an appropriate distance below the bottom surface of body 10 and locking screw 30 is tightened to retain blade 15 in this position. This adjustment determines the depth of cut of blade 15 into the mat. While both circle and oval-shaped openings may be cut, an oval-shaped opening is illustrated in FIG. 5 by way of example. In this illustration, two mat positioning pins 55, 56 are shown appropriately positioned by techniques understood in the art and cable 40 is shown extending around pins 55, 56 with cutter body 10 positioned to follow the line of cut 60 indicated in FIG. 5 with blade 15 cutting into the mat along line of cut 60. As those familiar with the Frameworks oval mat cutter will understand, an oval opening will be formed once body 10 and blade 15 has been moved along imaginary cut line 60 which is defined by the selected length and width of the oval being formed. A circular opening is cut by using one mat positioning pin and with cable 40 being used to form the radius of the desired circular opening.

Turning next to FIGS. 8–14 and the description of the preferred embodiment of the present invention, there is provided an adjustable template guide bar 70 having an elongated slot 71 which extends completely through template guide bar 70 and which is designed to receive the body portion of adjusting screw 50 residing in previously-mentioned horizontal guide slot 45 of body 10. Template guide bar 70 includes a thin guide vane member 75 which is spaced outwardly by means of a protrusion 76 and an opposite end of template guide bar 70 provides a tapered surface 80. The inner surface 74 of protrusion 76 provides the template engaging surface and which is angled so as to match the angle of the blade. This arrangement allows double mats to be cut without damaging the bevel on the top mat as surface 74 rides the top mat bevel during cutting of the lower mat. Template guide bar 70 can be placed in horizontal guide slot 45 in either of two positions. In one position indicated in FIGS. 11 and 12, template guide bar 70 is positioned so that template guide vane 75 is spaced outwardly below the bottom surface of cutter body 10. Also to be noted is that template guide bar 70 can be locked in an appropriate position by means of locking screw 50. Alternatively, template guide bar 70 can be reversed by turning guide bar 70 over, rotating it 180 degrees and passing the head of locking screw 50 through the enlarged portion 72 of slot 71 and in this latter mode, template guide vane 75 is effectively stored in a hollowed out portion 90 of cutter body 10 once screw 50 is tightened. This arrangement thus allows the cutter of the invention to be used either with cable 40 for circle or oval cutting, i.e., with template guide bar 70 in a "stored" position, or without cable 40 and with template guide bar 70 in position for cutting by use of a template. Later description deals with a form of cutter utilizing the template arrangement but without the oval/circle apparatus.

Figure 10:
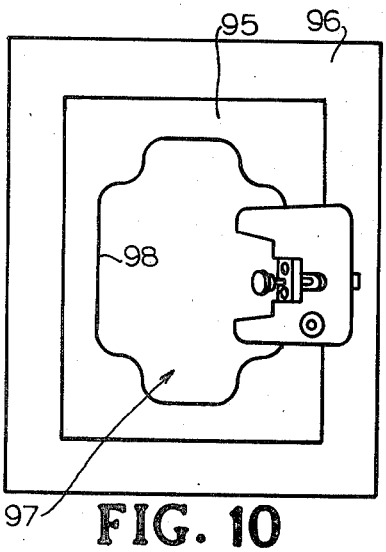
FIG. 10 illustrates the preferred embodiment, at a reduced scale, with a template guide placed on a mat preparatory to having an opening cut in the mat according to the template shape with the template guide in position on the cutter.
Figure 12:
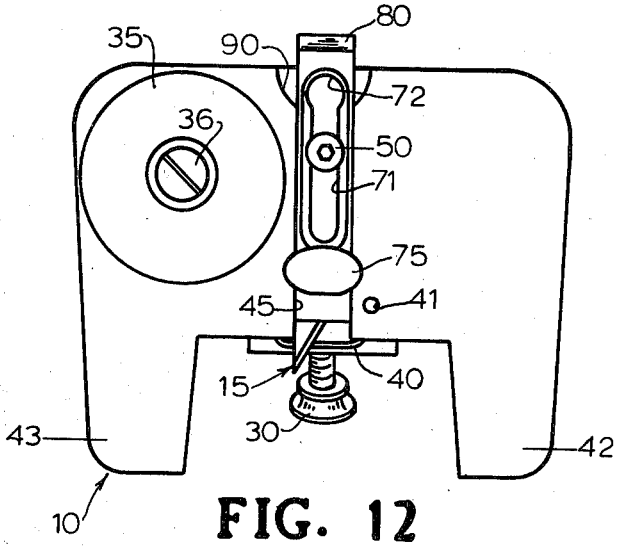
FIG. 12 is a bottom view of the cutter of FIG. 10 showing the template guide bar positioned for use.
Figure 11:
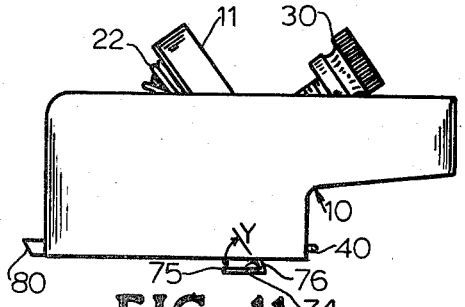
FIG. 11 is an elevation view of the preferred embodiment of FIG. 10 showing the template guide bar positioned for use.
Figure 13:
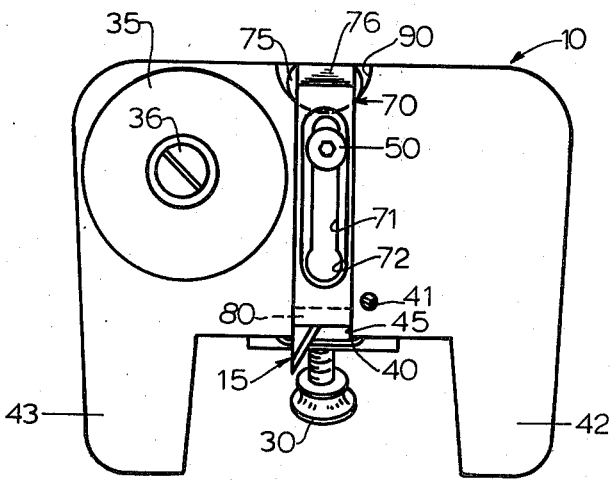
FIG. 13 is also a bottom plan view of the cutter of FIG. 10 with the template guide bar in a stored position.
Figure 14:
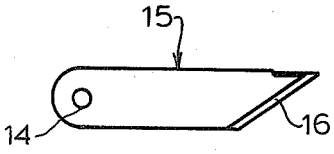
FIG. 14 is a plan view of the type mat cutter blade employed with the cutter of the invention.
Figure 15:
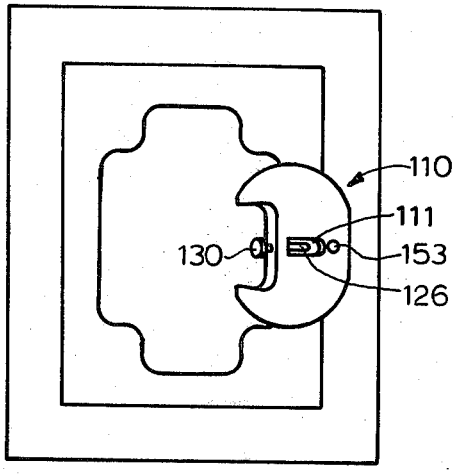
FIG. 15 illustrates an alternative embodiment, at a reduced scale, with a template guide placed on a picture frame mat preparatory to having an opening cut in the mat corresponding to the shape of the template opening.
Figure 16:
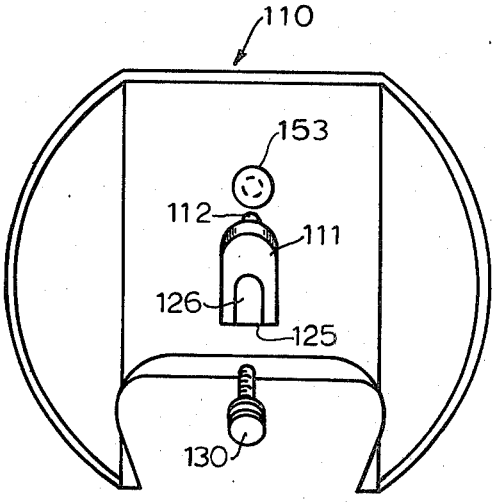
FIG. 16 is a top plan view of the alternative embodiment cutter of FIG. 15.
Figure 17:
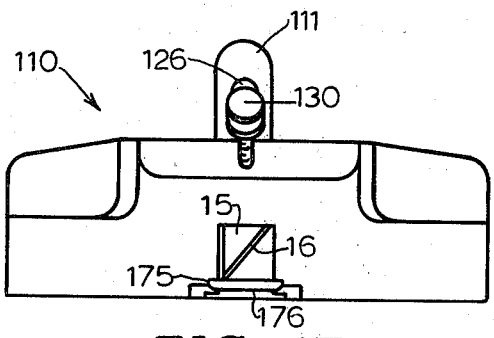
FIG. 17 is a front end view of the cutter of FIG. 15.

FIG. 10 illustrates a typical application for use of the cutter of the preferred embodiment of the invention when template guide bar 70 is placed as indicated in FIGS. 11 and 12. Referring to FIG. 10, a suitable template 95 is presumed to have been formed and it is further assumed that an opening 97 following the inner shape of template 95 is to be formed in the mat 96. To use the invention cutter for this purpose, blade support bar 11 would be appropriately positioned so as to extend blade edge 16 to an appropriate depth of cut and vane guide member 75 would be appropriately mounted so as to hook under the inner edge 98 of template 95 which would thus cause opening 97 to be formed according to the shape of template 95 as cutter body 10 is moved around template 95 so that blade 15 cuts into and through mat 96. A preferred angle of cut is 55° between blade edge 16 and the mat surface. Blade angle X and the template hook angle Y are therefore formed at 55° angles. Surface 74 is thus preferably at a 55° angle.

It can be seen that the preferred embodiment of the present invention provides a cutter which is suited not only to forming oval and circular openings but, equally important, is adapted to providing a means for forming any shape of mat opening which can be formed by template. For example, it will be appreciated that photographs or other materials can be cut into oval form without putting pin holes in the material being cut simply by cutting a template according to the desired shape and using the cutter of the invention in the manner described. Cathedral maps, mats with oval tops and bottoms and straight sides, rectangular mats with round corners and free form mats have all been cut with the device of the preferred embodiment of the invention. The cutter can also be used to form a template which can then be used in cutting other mats following such template. Additionally, one cut mat can be used as a template to get a double mat effect with the width of the inlay border being determined by where adjustable template guide bar 70 is set. Also, one cut mat can be readily duplicated on a slightly smaller scale by using such cut mat as a template for the duplicate.

An alternative embodiment will next be described with reference to FIGS. 15 through 19. The cutter of the alternative embodiment is adapted specifically for use with a template and is not adjustable. The cutter is a low-cost cutter which is useful for cutting rectangular openings and special shaped openings. Circle and oval openings may be cut if the template opening is circular or oval in shape. The spool/cable arrangement of the preferred embodiment is not incorporated in this low-cost version although that feature could be incorporated and not interfere with the features to be described.

Cutter body 110 of the alternate embodiment provides a central, angularly disposed guide slot 125 and slidably mounts therein a blade support bar 111 similar to the previously described blade support bar 11. An integral pin 112 extends from the back surface of bar 111. Similar to the first embodiment, pin 112 is adapted to receive the aperture 14 of cutter blade 15 when mounted against the back surface of blade support bar 111. In such position, the cutting edge 16 of blade 15 extends outwardly below the top tapered surface 120 of blade support 111 corresponding to surface 20 of bar 11. Pin 112 receives one end of a coiled spring 122 which is otherwise mounted immediately behind blade support bar 111 in an appropriate portion of the angularly disposed guide slot 125. Blade support bar 111 on its front or outer surface also includes a hollowed out cavity 126. An adjustable locking screw 130 is threadably mounted in cutter body 110 to engage cavity 126 so as to allow blade support bar 111 and mounted blade 15 to be adjustably positioned for cutting. As in the preferred embodiment whenever locking screw 130 is loosened, coil spring 122 acts to force blade support 111 and mounted blade 15 upwardly into a safe retracted position within cutter body 110 and which position can be secured by tightening locking screw 130.

Figure 19:
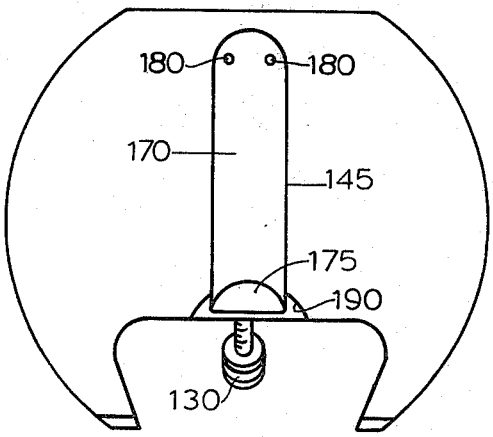
FIG. 19 is a bottom plan view of the cutter of FIG. 15.

Cutter body 110 includes a horizontal slot 145 in its bottom surface, as seen in FIG. 19, and in which there is mounted a pivotal template guide 170 secured by rivets 180. Template guide 170 comprises a thin, flexible strip having a thin template guide vane 175 supported on an outwardly extending protrusion 176. An enlarged portion 190 of slot 145 is adapted to receive template guide vane 175 as seen in FIG. 19. Guide 170 and vane 175 normally rest within slot 145 which enables the base of cutter body 110 to reside flat on the mat surface during use. A hole 150 formed through and centrally of cutter body 110 terminates with an enlarged portion immediately above guide member 170 and mounts a vertically slidable pin 152 which can be used to pivot guide 170 as required. Pin 152 is composed of a head 153, stem 154, abutment 155 and a stub 156. Head 153 limits downward movement and abutment 155 limits upward movement of pin 152.

Figure 18:
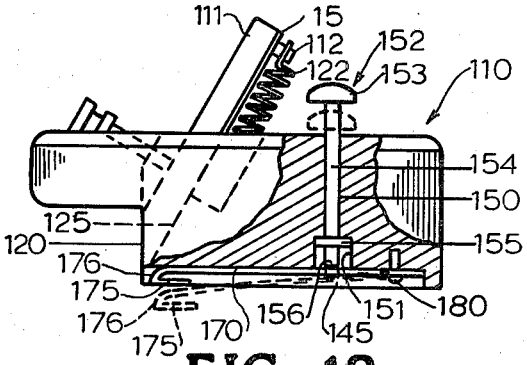
FIG. 18 is a side view of the cutter of FIG. 15, partially in section.

As illustrated in FIG. 18, downward movement of pin 152 by the operator pressing on head 153 causes stub 156 to engage and pivot guide 170 which enables vane 175 to be properly positioned for engaging the template. Once the template is positioned between vane 175 and guide 170, pressure on pin 152 can be released and guide 170 will remain deployed until it is removed from contact with the template. Thus, both embodiments adapt to use with templates corresponding to a wide range of opening shapes. However, where the cable arrangement of the first embodiment is not required a more economical yet dependable and timesaving cutter for the industry is provided by the cutter of the second embodiment.

What is claimed is:

1. A picture frame mat opening cutter comprising:

(a) a cutter body adapted for being manually grasped and manipulated to form an opening in a picture frame mat, said cutter body having a flat bottom surface with a horizontal guide slot formed centrally therein and having an angularly disposed guide slot formed in said cutter body;

(b) a blade support bar slidably mounted in said angularly disposed guide slot and providing a blade mounting surface thereon;

(c) a mat opening cutter blade detachably mounted on said blade support bar surface for slidable movement therewith;

(d) spring means mounted within said cutter body and operative on said blade support bar enabling said blade support bar and said blade mounted thereon to be constantly tensioned in a retracted blade direction;

(e) means mounted on said cutter body and adapted to adjustably locate said blade support bar and said blade mounted thereon in a position appropriate to cutting a preselected mat opening; and (f) an elongated template guide bar movably mounted in said horizontal guide slot, said guide bar having an outwardly angled protrusion at its forward end from which a thin, flat guide vane extends rearwardly from the outer edge thereof to form a hook structure with said protrusion adapted to engage a template edge as a guide for forming a mat opening according to the shape of opening formed in said template.

2. A picture frame mat opening cutter as claimed in claim 1 wherein the inner surface of said protrusion provides an engaging surface angled parallel to the angle of said angularly disposed slot thereby enabling said hook structure when making double mats to engage a top mat bevel while said blade cuts a bottom mat bevel at the same angle.

3. A picture frame mat opening cutter as claimed in claim 1 wherein said movably mounted template guide bar is adjustable along the length of said horizontal guide slot and including means adapted to provide for said adjustable positioning of said template guide bar and to maintain said template guide bar in a selected position along the length of said horizontal guide slot.

4. A picture frame mat opening cutter as claimed in claim 1 wherein said template guide bar is fixedly secured at one end in said horizontal guide slot and is adapted for pivoting downwardly out of said horizontal guide slot enabling said template guide vane to clear said cutter body flat bottom surface for engagement with said template edge.

5. A picture frame mat opening cutter as claimed in claim 4 including finger engaging means effecting the downwardly pivoting movement of said template guide bar.

6. A picture frame mat opening cutter as claimed in claim 5 wherein said template guide bar comprises a leaf spring fixedly secured at said one end and mounting said vane on an opposite pivotal end and adapted for flexing back to its original position in said horizontal guide slot whenever said finger engaging means is released.

7. A picture frame mat opening cutter comprising:

(a) a cutter body adapted for being manually grasped and manipulated to form picture frame mat openings, said cutter body having a flat bottom surface with a horizontal guide slot formed centrally therein and having an angularly disposed guide slot formed in said cutter body;

(b) a blade support bar movably mounted in said angularly disposed guide slot and providing a blade mounting surface thereon;

(c) a mat opening cutter blade detachably mounted on said blade support bar surface for slidable movement therewith;

(d) spring means mounted within said cutter body and operative on said blade support bar enabling said blade support bar and said blade mounted thereon to be constantly tensioned in a retracted blade direction;

(e) means mounted on said cutter body and adapted to adjustably locate said blade support bar and said blade mounted thereon in a position appropriate to cutting a preselected mat opening;

(f) a spring loaded spool member mounted in a lower portion of said cutter body and including a flexible retractable cable wound thereon with an outer end secured to said cutter body, said cable being adapted to be withdrawn from said cutter body forward of said mat opening cutter blade for encircling appropriate mat positioning pins to form circle, oval openings, and the like, in a selected picture frame mat;

(g) means for locking said spool means in a selected position with said cable withdrawn a selected amount; and (h) an elongated template guide bar adjustably mounted in said horizontal guide slot, said guide bar having an outwardly angled protrusion at its forward end from which a thin, flat guide vane extends rearwardly from the outer edge thereof to form a hook structure with said protrusion adapted to engage a template edge as a guide for forming a mat opening according to the shape of opening formed in said template.

8. A mat opening cutter as claimed in claim 7 wherein said cutter body bottom side is formed to provide at one end thereof a storage receptacle for receiving said template guide bar guide vane in a stored inoperative position.

9. A mat opening cutter as claimed in claim 7 wherein said angularly disposed guide slot is formed so as to mount said cutter blade at a cutting angle of substantially 55° with respect to said cutter body bottom surface and wherein said template guide bar and guide vane in operative position are disposed to engage and follow an edge of comparable angular contour.

10. A picture frame mat opening cutter as claimed in claim 7 wherein said movably mounted template guide bar is adjustable along the length of said horizontal guide slot.

11. A picture frame mat opening cutter as claimed in claim 10 including means adapted to provide for said adjustable positioning of said template guide bar and to maintain said template guide bar in a selected position along the length of said horizontal guide slot.

12. A picture frame mat opening cutter as claimed in claim 7 wherein said movably mounted template guide bar is fixedly secured at one end in said horizontal guide slot so that said template guide bar is capable of pivoting downwardly out of said horizontal guide slot so that said template guide vane is clear of said cutter body flat bottom surface for engagement with said template edge.

13. A picture frame mat opening cutter as claimed in claim 7 including finger engaging means effecting the downwardly pivoting movement of said template guide bar.

14. A picture frame mat opening cutter as claimed in claim 13 wherein said template guide bar comprises a leaf spring fixedly secured at said one end and mounting said vane on an opposite pivotal end and adapted for flexing back to its original position in said horizontal guide slot whenever said finger engaging means is released.

* * * * *

UNITED STATES PATENT AND TRADEMARK OFFICE

CERTIFICATE OF CORRECTION

PATENT NO. : 4,176,452

DATED : December 4, 1979

INVENTOR(S) : Richard W. Duggins & James W. Rodgers

It is certified that error appears in the above-identified patent and that said Letters Patent are hereby corrected as shown below:

Col. 2, line 48, "construction" should be --constructions--.

Col. 5, line 27, insert --bar-- before "111".

Signed and Sealed this

Tenth Day of June 1980

[SEAL]

Attest:

SIDNEY A. DIAMOND

Attesting Officer

Commissioner of Patents and Trademarks